US005667666A

United States Patent [19]

Matsuura et al.

[11] Patent Number: 5,667,666

[45] Date of Patent: Sep. 16, 1997

[54] PROCESS FOR ELECTROCHEMICALLY ROUGHENING A SURFACE OF A METAL WEB

[75] Inventors: Atsushi Matsuura; Akio Uesugi, both of Shizuoka, Japan

[73] Assignee: Fuji Photo Film Co., Ltd., Kanagawa, Japan

[21] Appl. No.: 689,067

[22] Filed: Jul. 30, 1996

[30] Foreign Application Priority Data

Jul. 31, 1995 [JP] Japan ..... 7-194881

[51] Int. Cl.[6] ..... C25F 3/02

[52] U.S. Cl. ..... 205/640; 205/658; 205/659; 205/651

[58] Field of Search ..... 204/DIG. 9; 205/651, 205/658, 659, 660, 674

[56] References Cited

U.S. PATENT DOCUMENTS

| | | | |
|---|---|---|---|
| 4,315,806 | 2/1982 | Arora | 205/658 |
| 4,377,447 | 3/1983 | Bednarz | 205/50 |
| 4,533,444 | 8/1985 | Oda et al. | 204/DIG. 9 |
| 4,536,264 | 8/1985 | Masuda et al. | 204/DIG. 9 |
| 4,919,774 | 4/1990 | Minato et al. | 205/651 |
| 5,358,610 | 10/1994 | Kawasumi et al. | 205/658 |

FOREIGN PATENT DOCUMENTS

| | | |
|---|---|---|
| 317866 | 5/1989 | European Pat. Off. . |
| 2336261 | 7/1977 | France . |
| 879768 | 11/1951 | United Kingdom . |

*Primary Examiner*—Donald R. Valentine

*Attorney, Agent, or Firm*—Sughrue, Mion, Zinn, Macpeak & Seas

[57] ABSTRACT

A process for roughening a surface of a support for a lithographic printing plate in which an electric current is supplied between a metal web and an electrode facing the metal web in an electrolyte containing metal ions so that the metal web is subjected to electrochemical processing continuously, 1–20 pause sections are provided in the electrochemical processing and the time taken for passage through once processing pause section in the electrochemical processing is set to 1–30 seconds. With the process, the grain shape can be controlled with no troublesome condition setting to improve a scumming resistance without deteriorating a printing durability and a fill-in reduction so that the plate has superior performance.

6 Claims, 3 Drawing Sheets

PROCESS FOR ELECTROCHEMICALLY ROUGHENING A SURFACE OF A METAL WEB

BACKGROUND OF THE INVENTION

1. Field of the Invention

The present invention relates to a process for toughening a surface of a support for a lithographic printing plate, and particularly relates to such a surface roughening process which is performed by electrochemical processing, which is superior in print performance, and which is simple and easy.

2. Description of the Related Art

In an electrochemical surface treating process for a support for a lithographic printing plate, it is important to improve a printing durability, a scumming resistance, and a fill-in reduction by controlling the grained surface structure.

U.S. Pat. No. 5,304,298 proposes a process for roughening aluminum or aluminum alloys useful as support material for printing plates, in which the process having two electrochemically roughening steps are carried out in direct succession and are followed by a pickling step. Printing plates are produced from this support material by coating with light-sensitive coatings, which printing plates, when exposed and developed, give corresponding printing formes of very uniform topography, high run stability and good damping agent supply.

The process can be carried out discontinuously or continuously with strips of aluminum or its alloys in the U.S. Pat. No. 5,304,298. This patent discloses preferable process parameters in the continuous process during the roughening steps, for example, the temperature of electrolyte, the current density, the dwell time in the electrolyte of a section of material to be roughened, and the electrolyte flow rate at the surface of the material to be roughened. FIG. 1 is a side view of a conventional example having no pause section.

In the above conventional process, however, the ranges are defined strictly with respect to all the conditions and it is difficult to obtain optimum conditions.

SUMMARY OF THE INVENTION

It is an object of the present invention to provide a process for roughening a surface of a support for a lithographic printing plate in which a grain shape can be controlled without requiring any setting of troublesome conditions and as a result, improving a printing durability, a scumming resistance, and a fill-in reduction.

The above object can be achieved by a process for roughening a surface of a support for a lithographic printing plate in which an electric current is supplied between a metal web and an electrode facing the metal web in an electrolyte containing metal ions so that the metal web is subjected to electrochemical processing continuously, characterized in that 1–20 pause sections are provided in the electrochemical processing and the time taken for passage through once processing pause section in the electrochemical processing is set to 1–30 seconds, In the present invention, the phrase 1–20 pause sections are provided in the electrochemical processing defines the number of places where the electrochemical processing is not carried out, and specifically defines the number of discontinued portions between electrodes where electric current conduction is not effected. This definition comes from the fact that the web travels continuously through the electrolyte. If this number is 20 or more, the grain shape gets out remarkably.

Even if the time of passage through each processing pause in the electrochemical processing exceeds 30 seconds, the grain shape does not change and the prolongation of time is meaningless.

DESCRIPTION OF THE PREFERRED EMBODIMENTS

The present invention employs a process for producing an aluminum support for printing plate disclosed in U.S. Pat. No. 4,902,389 (corresponding to European Patent No. 317866), and embodiments of the present invention illustrated by the drawings.

Figure 1:
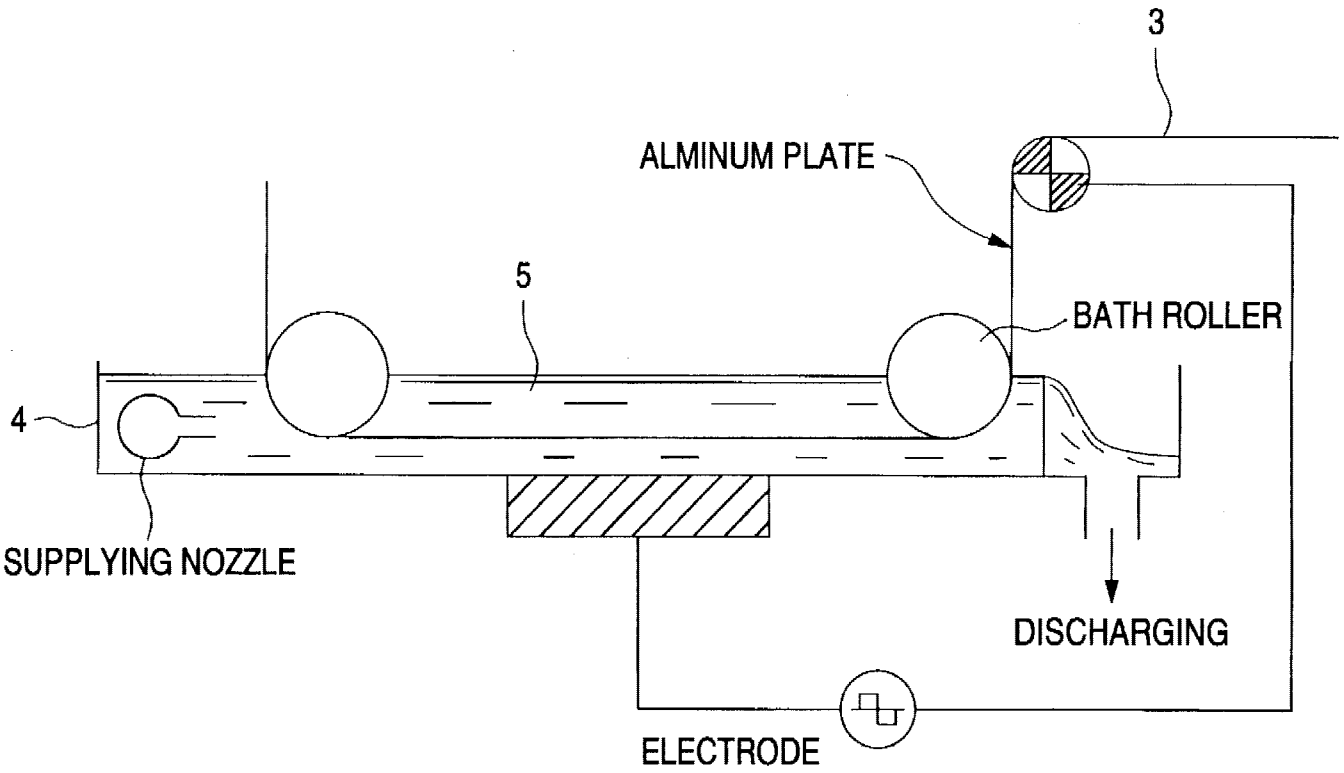
FIG. 1 PRIOR ART
FIG. 1 is a side view showing an example of a conventional electrochemically surface-roughening process.
Figure 2:
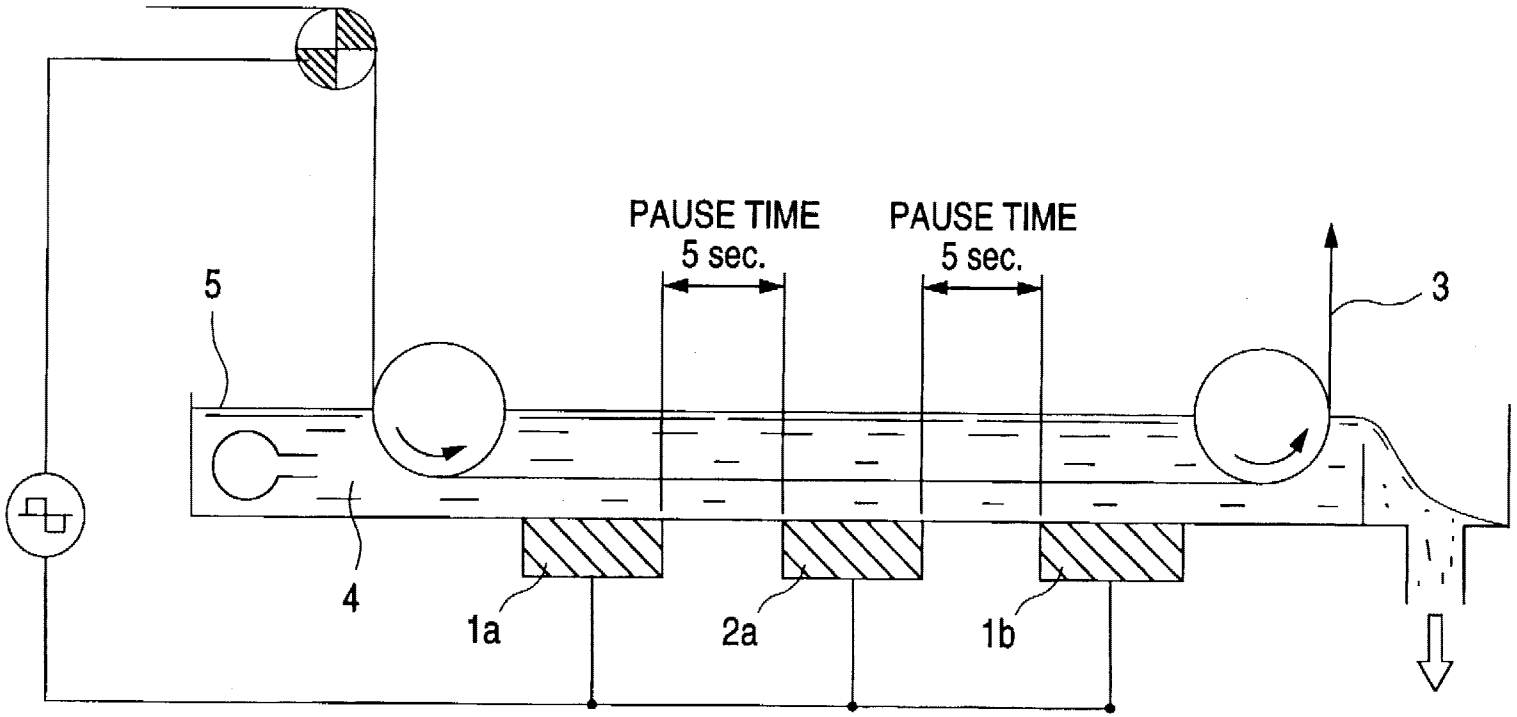
FIG. 2 is a side view showing an embodiment of an electrochemically surface-roughening process according to the present invention.

FIG. 2 is a side view of an embodiment of the present invention in which discontinued portions of electrode plates between electrodes 1 and 2. If it takes 5 seconds for a metal web 3 to pass through each discontinued portion, the time taken for the metal web to pass through all the processing pause sections is 10 seconds when the number of the processing pause sections is two. The metal web 3 is continuously immersed inside an electrochemical cell 4 from the first to the end.

Figure 3:
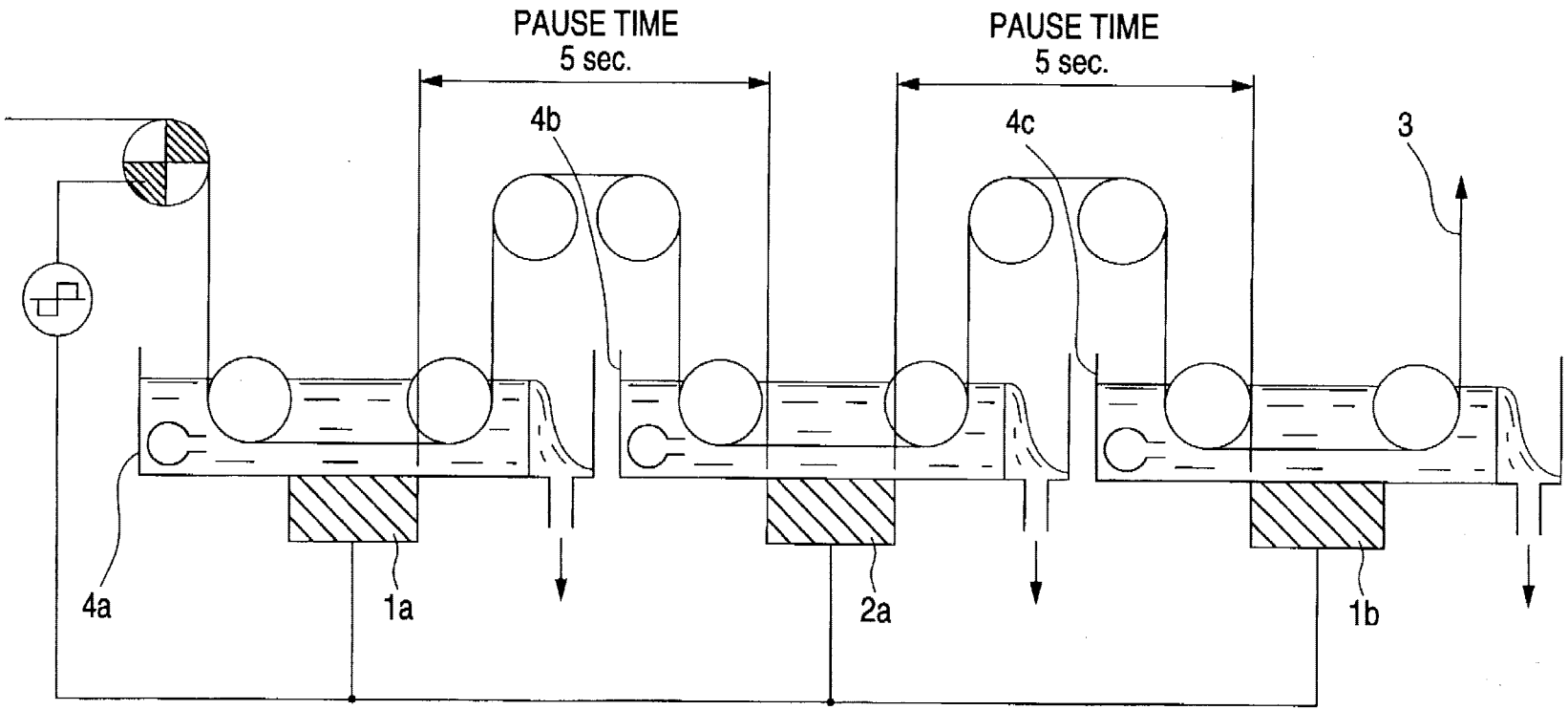
FIG. 3 is a side view showing another embodiment of the electrochemically surface-roughening process according to the present invention.

FIG. 3 is a side view of another embodiment of the present inventions in which an electrochemical cell 4 is formed of three cells, that is, a first electrochemical cell **4*a*, a second electrochemical cell 4*b* and a third electrochemical cell 4*c*. In each electrochemical cell, there are provided electrodes 1*a*, 2*a* and 1*b*** so that the number of times of pause of the electrochemical processing is two, that is, at a place where a web enters the second cell from the first cell and another place where the web enters the third cell from the second cell. The time for passage through each processing pause section is 5 seconds and the total time for passage through the respective processing pause sections is 10 seconds. In the embodiment of FIG. 2, the kind of the electrolyte is only one because there is only one electrochemical cell, while in the embodiment of FIG. 3, it is possible to change the electrochemical conditions in the respective cells because the configuration has three cells.

EXAMPLES

Next, examples according to the present invention are described below. A rolled aluminum web of JIS 3003-H14 was immersed in a 10% aqueous solution of sodium hydroxide for 30 seconds so as to be subjected to cleaning and then washed with water.

The thus treated aluminum web was conveyed continuously through such an electrochemical cell 4 as shown in each of FIGS. 2 and 3. Fourteen electrodes 1 made from platinum and fourteen electrodes 2 made from carbon were alternately provided at intervals of 100 mm in an electrolyte 5 and the aluminum web 3 was conveyed above each of the electrodes 1 and 2 while maintaining the distance of 10 mm between the aluminum web 3 and each electrode. At that time, the electric current density for each electrode was 30 $A/cm^2$ and an sinusoidal-wave AC was used. The length of each of the electrodes 1 and 2 in the direction of travel of the aluminum web was 100 mm. Test was effected under the conditions that the travelling velocity of the aluminum web 3 was kept constant, while the intervals of the electrodes, the umber of pause, and the time of pause changed.

The electrolyte 5 used was an aqueous solution containing a nitric acid by 15 g/l, and the liquid temperature was 45° C. The aluminum web 3 which came out of the electrochemical cell 4 was washed with water, then immersed in an aqueous solution containing a sulfuric acid by 300 g/l for 50 seconds at 60° C. to thereby remove a smut component mainly containing an aluminum hydroxide produced by the electrochemical surface roughening, and thereafter washed with water.

The thus obtained web with a roughened surface had uniform honey-comb pits with average surface graininess of 0.21 μm. The average diameter of the pits was 3 μm.

The thus obtained aluminum web was subjected to anodization processing in an aqueous solution containing a sulfuric acid by 100 g/l at 35° C. so that the quantity of oxide film became 2.0 g/m$^2$. Then, after washed with water, the aluminum web was immersed in an aqueous solution containing No. 3 silicate of soda by 2.5% for 20 seconds at 70° C. to be subjected to hydrophilic processing.

The thus obtained aluminum web was coated with a photosensitive layer to thereby produce a printing plate. On the thus obtained printing plate, evaluation was conducted about printing properties (a printing durability, a scumming resistance, and a fill-in reduction). Table 1 shows the result of the evaluation.

In the present invention, the term "fill-in reduction" defines a resistance to scumming in a non-image area from an intermediate portion of dot to a shadow portion.

TABLE 1

| | Pause of Processing | | Quantity | Printing Performance | | |
|---|---|---|---|---|---|---|
| | Number of Times | Pause for Once | of Electricity (c/dm$^2$) | Printing durability | Scumming | Fill-in |
| Comparative Example 1 | No pause | | 250 c/dm$^2$ | 100% | C | B |
| Comparative Example 2 | Once | 0.5 sec. | " | 100% | C | B |
| Example 1 | Once | 1 sec. | " | 100% | BC | B |
| Example 2 | Once | 5 sec. | " | 100% | B | B |
| Example 3 | Once | 30 sec. | " | 100% | AB | B |
| Comparative Example 3 | Once | 40 sec. | " | 100% | C | B |
| Example 4 | 5 times | 5 sec. | " | 100% | AB | B |
| Example 5 | 20 times | 5 sec. | " | 100% | A | B |

TABLE 1-continued

| | Pause of Processing | | Quantity | Printing Performance | | |
|---|---|---|---|---|---|---|
| | Number of Times | Pause for Once | of Electricity (c/dm$^2$) | Printing durability | Scumming | Fill-in |
| Comparative Example 4 | 25 times | 5 sec. | " | 90% | B | B |

Note: A: superior; B: good; C: fairly good

By provision of pause portions, it was made possible to improve the scumming resistance without deteriorating the printing durability and the fill-in performance).

As described above, the present invention can ensure the following effects by the electrochemically surface-roughening process:

(1) The grain shape and the printing performance can be controlled by varying the time for pause and the number of pause; and (2) The scumming resistance can be improved without deteriorating the printing durability and the fill-in performance.

It should also be understood that the foregoing relates to only a preferred embodiment of the invention, and that it is intended to cover all changes and modifications of the examples of the invention herein chosen for the purposes of the disclosure, which do not constitute departures from the spirit and scope of the invention.

What is claimed is:

1. A process for roughening a surface of a metal web, comprising the steps of:

alternating applying, from one terminal of a power source, a positive current and a negative current to a plurality of electrodes, each of said electrodes being spaced apart from adjacent electrodes by a pause section;

subjecting the metal web to electrochemical processing in an electrolyte by an electric current formed between the metal web and the plurality of electrodes facing the metal web; and pausing the electrochemical processing at the pause section between two of said electrodes for 1 to 30 seconds.

2. The process as claimed in claim 1, wherein the pausing step is carried out 1 to 20 times in the roughening process.

3. The process as claimed in claim 1, wherein the pause section is provided in an electrolytic cell.

4. The process as claimed in claim 1, wherein the pause section is provided between two adjacent electrolytic cells.

5. A process as claimed in claim 1 or 2, wherein the electrochemical processing is carried out using sinusoidal-wave A.C.

6. A process as claimed in claim 1, 2 or 5, wherein the electrolyte consists essentially of nitric acid.

* * * * *